US006476777B1

(12) United States Patent
Lin et al.

(10) Patent No.: US 6,476,777 B1
(45) Date of Patent: Nov. 5, 2002

(54) ANTENNA ASSEMBLED BY VACUUM AND STATIC ELECTRIC ATTRACTION

(75) Inventors: Jammy Lin, Tuu-Cheng (TW); Ping Kun We, Tao-Yuan (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/962,153

(22) Filed: Sep. 26, 2001

(51) Int. Cl.[7] ..... H01Q 1/36
(52) U.S. Cl. ..... 343/895; 343/906
(58) Field of Search ..... 343/895, 702, 343/900, 715, 906; H01Q 1/36, 1/24

(56) References Cited

U.S. PATENT DOCUMENTS 6,268,836 B1 * 7/2001 Faulkner et al. ..... 343/895
6,337,669 B1 * 1/2002 Chiang ..... 343/895

* cited by examiner

*Primary Examiner*—Michael C. Wimer
(74) *Attorney, Agent, or Firm*—Troxell Law Office PLLC

(57) ABSTRACT

An antenna assembled by actions of vacuum and static electric attraction, which includes a sleeve and an inner connecting rod able to be inserted in and connected to the sleeve and installed therein a helix coil and a metallic connecting seat, the sleeve and the connecting rod are made of flexible material of different friction coefficients; the sleeve has an upper closed end and a bottom opening, an inner bore with plural sections with their diameters gradually enlarged from the inside to the outside are provided therein, at least two inner annular recesses are longitudinally distributed along the antenna to prevent air from communication with the outside and to generate attraction; the connecting rod has plural rod sections corresponding by position to the plural sections of the inner bore, and plural annular protrusions of identical cross-sectional shapes respectively to those of the annular recesses are provided on the inner connecting rod which is inserted through the bottom of and fits the sleeve tight. The static electric attraction induced by the different material and the vacuum state render the inner connecting rod and the sleeve connected with each other fast and firm.

6 Claims, 3 Drawing Sheets

ANTENNA ASSEMBLED BY VACUUM AND STATIC ELECTRIC ATTRACTION

BACKGROUND OF THE INVENTION

1. Field of the invention

The present invention is related to an antenna assembled by actions of vacuum and static electric attraction; and especially to an antenna of which the assembling process of an insulating sleeve and an inner connecting rod will make generating of static electric friction and vacuum attraction to result fixed engagement between the two elements directly.

2. Description of the Prior Art

Most antennas such as the fixed-type antennas used in mobile phones use interior helical coils as the main elements for transmitting and receiving frequency. The bottom of a helical coil on the one hand is connected with a metallic connecting seat, and on the other hand is positioned, sheltered and insulated by an inner connecting rod and a sleeve related therewith.

In such a conventional structure of fixed-type antenna for a mobile phone, the bottom of the helical coil firstly can be connected with the metallic connecting seat and positioned by means of the insulated inner connecting rod, and then the sleeve is mounted (it is generally called as a cap portion). This kind of combination structure can be further combined through a high frequency welding process or the like. Or in another kind of manufacturing method, the related elements of the positioned helical coil and metallic connecting seat will be placed in a mold, and then the sleeve is shaped by ejection-enveloping procedure. However in this structure processed, it is less convenient to have the preliminarily assembled elements installed in a mold, as a necessary procedure, for processing on the one hand; and the speed of the mass production will be slowed down by that every product in the production process has to be put in the mold on the other hand.

SUMMARY OF THE INVENTION

The object of the present invention is to provide a structure of an antenna assembled by actions of vacuum and static electric attraction. After an inner connecting rod (used to position a helical coil) and a sleeve are shaped separately, the two will engage firmly with each other by static-electric friction and vacuum attraction in a fast and direct manner. This can thereby increase the efficiency of mass production of the antenna.

In order to obtain the abovementioned purpose, the sleeve in this invention has an upper closed end, a bottom opened end and an inner bore with a plurality of sections with their diameters gradually enlarged from the inside to the outside. There are two or more than two inner annular recesses provided longitudinally along the inner bore sections. A plurality of rod sections and annular protrusions with identical cross-sections respectively to those of the annular recesses are provided on the inner connecting rod at the positions respectively corresponding with the abovementioned inner bore sections, the inner connecting rod can be inserted in and matched with the inner bore through an bottom opening. The abovementioned sleeve and inner connecting rod are made of the material of different coefficients of friction, and the connecting surfaces of the two elements are polished to become smooth surfaces so as to generate vacuum and static electric attraction to create mutually engaging force in the insertion connecting process.

Under the condition that the insertion connecting elements are made of material of different friction-coefficients as is mentioned above, One of the insertion connecting elements can be made of silicone or mixed material of rubber and plastic, the other insertion connecting element can be of pure plastic material.

The present invention will be apparent in its novelty and other features after reading the detailed description of the preferred embodiment thereof in reference to the accompanying drawings.

DETAILED DESCRIPTION OF THE PREFERRED EMBODIMENT

Figure 1:
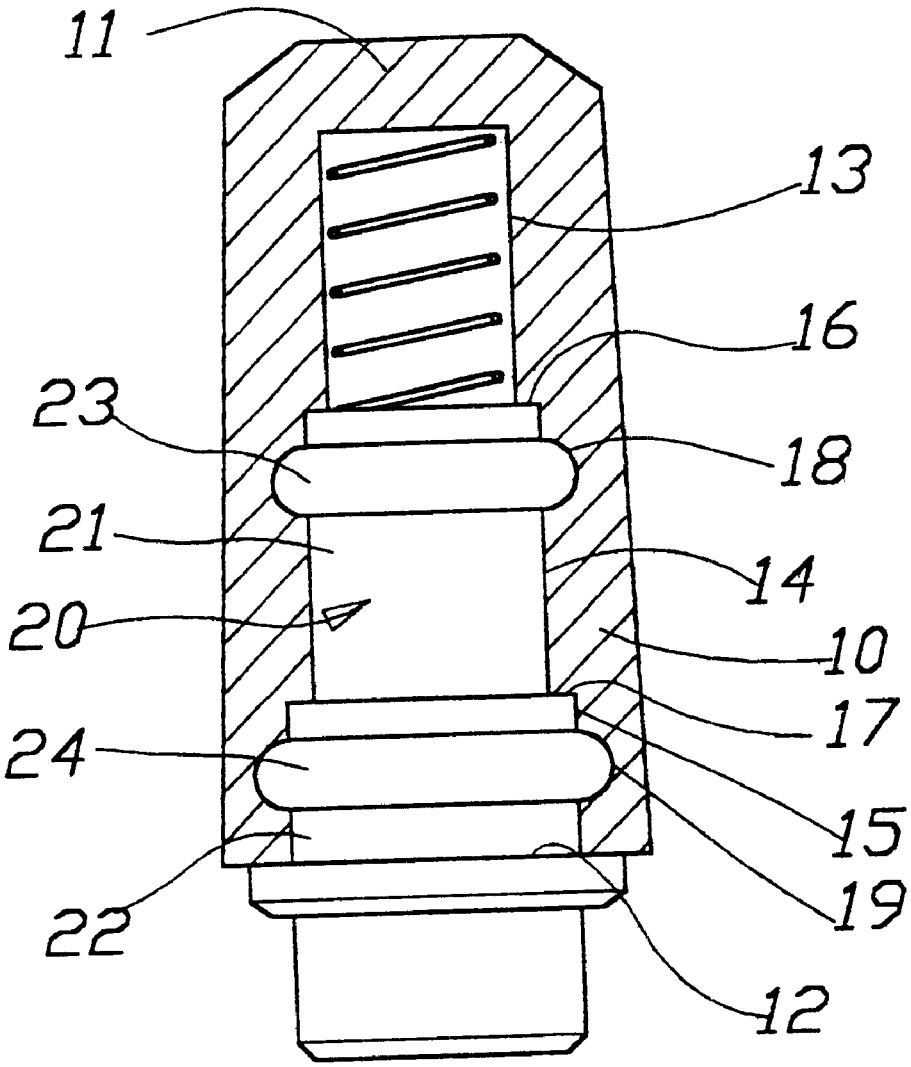
FIG. 1 is a sectional view showing the sleeve and the inner connecting rod of an embodiment of the present invention are under an assembled condition.

Referring to FIG. 1, the antenna combination structure in the present invention is mainly comprised of a sleeve 10 (that is a cap potion) and an inner connecting rod 20. For the purpose of generating the necessary static electric friction and vacuum attraction, it is most preferred to have the sleeve 10 and the inner connecting rod 20 made of two kinds of plastic material of different characteristics.

The most desired material for the abovementioned sleeve 10 is the mixed material of silicone and plastic or rubber and plastic. In the mixed material, the ingredients silicone and rubber are most preferably over 30%. In the embodiment as shown in the drawing, the sleeve 10 is provided with an upper closed end 11 and a bottom opening 12; a first inner bore section 13, a second inner bore section 14 and a third inner bore section 15 are sequentially connected inside thereof. The diameter of the second inner bore section 14 is larger than the that of the first inner bore section 13 so as to form a first inner stepped portion 16. The diameter of the third inner bore section 15 is larger than that of the second inner bore section 14 to form a second inner stepped portion 17. In the second inner bore section 14, a first inner annular recess 18 with a diameter larger than that of the second inner bore section 14 is provided. And in the third inner bore section 15, a second inner annular recess 19 with a diameter larger than that of the third inner bore section 15 is provided. The first and second inner annular recesses 18,19 are preferably distributed longitudinally at an upper and a lower position to form desired fastening and positioning faculties, and to prevent the air from communication with the outside so as to generate an attraction effect. For example, the first inner annular recess 18 is provided at an upper position in the longer second inner bore section 14, and the second inner annular recess 19 is provided at the middle position in the shorter third inner bore section 15.

Besides, the inner surfaces of the inner connecting rod 20 directly contacting with the second inner bore section 14 and the third inner bore section 15 of the sleeve 10 are preferably polished, thus a static electricity engaging can be produced (detailed explanation of this will be provided later on) during the assembling process.

The inner connecting rod 20 used to match and connect with the abovementioned inner bore of the sleeve 10 is preferably made of pure plastic family material. It has a different friction coefficient from that of the sleeve 10 made of mixed material and thus will generate good static electric friction. In the embodiment as shown in the drawing, the inner connecting rod 20 is provided with a first rod section 21 in corresponding to the second inner bore section 14 of the sleeve 10, and a second rod section 22 in corresponding to the third inner bore section 15. And a first annular protrusion 23 and a second annular protrusion 24 are provided at the positions in corresponding to and are of identical cross-sectional shapes to those of the above mentioned first inner annular recess 18 and second inner annular recess 19. The contacting surfaces between the abovementioned inner connecting rod 20 and the sleeve 10 shall be polished. At the same time, every outer diameter of the inner connecting rod 20 and every related inner diameter of the sleeve 10 shall not interfere with each other excessively or too loosely, it is preferred to have tight matching in the assembling process.

Figure 3:
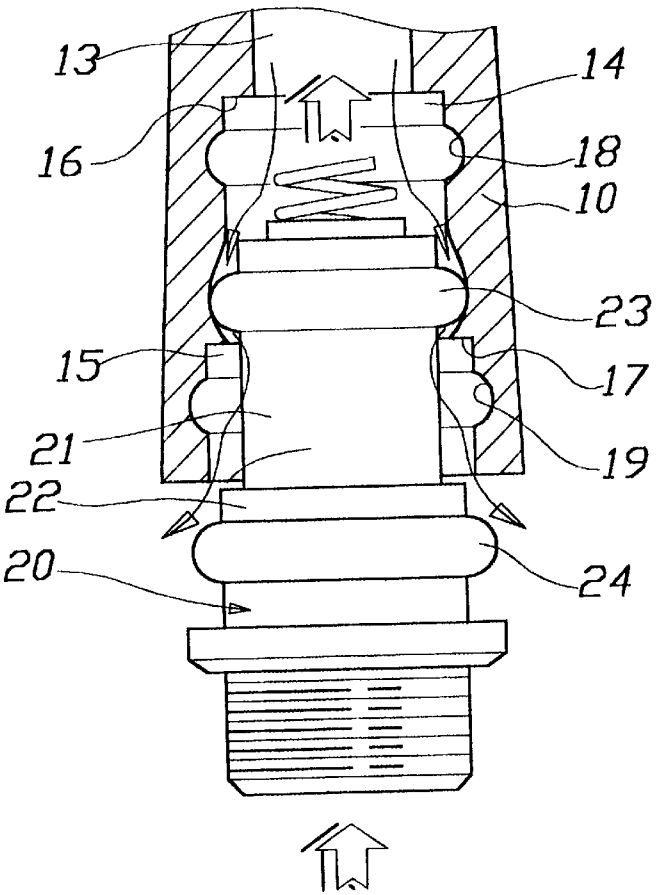
FIG. 3 is a sectional view showing the inner connecting rod in FIG. 2 has been in position and is ready for assembling.
Figure 2:
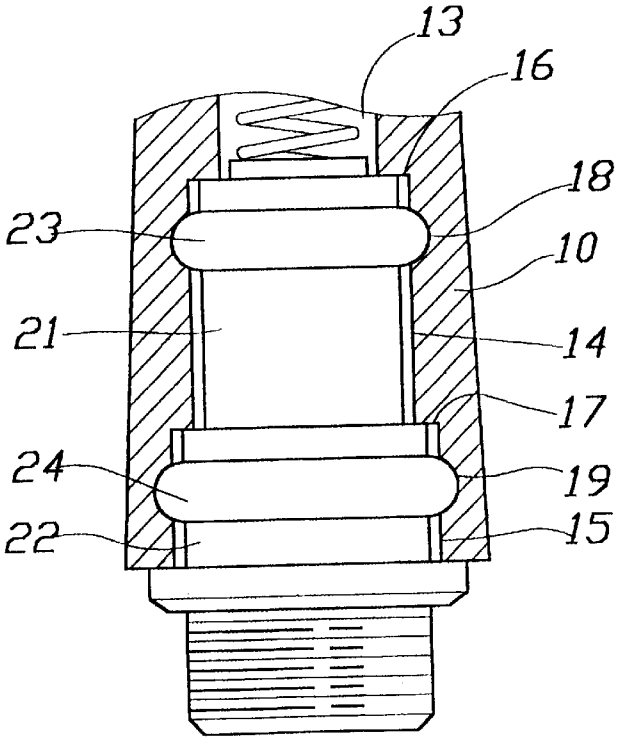
FIG. 2 is a schematic sectional view showing the partial inserting and connecting actions of the inner connecting rod in FIG. 1.

Referring to FIG. 2, in the assembling process of the present invention, the end portion of the inner connecting rod 20 can be inserted from the bottom opening 12 of the sleeve 10, and the sleeve 10 made of mixed material will be slightly expanded. In this inserting process, since the sleeve 10 is expanded slightly, the interior air of the sleeve 10 will be exhausted gradually along the arrow direction as shown. Then the pressure in the inner bore of the sleeve 10 will be lowered or close to vacuum and becomes much less than the atmosphere pressure. In this inserting process, the related outer diameters of the inner connecting rod 20 and the related inner diameters for positioning the sleeve 10 will generate friction and static electric attraction due to tight matching and being made of different material; after the inner connecting rod 20 is inserted completely in position (as shown in FIG. 3), assembling of the two elements is completed by restoration of elasticity of the slightly expanded sleeve 10. Under this completed assembling condition, the two elements obtain a firm mutual engaging function by virtue that the interiors of the assembled elements are under a low-pressure status close to vacuum, and attraction is generated by static electric friction.

Figure 4:
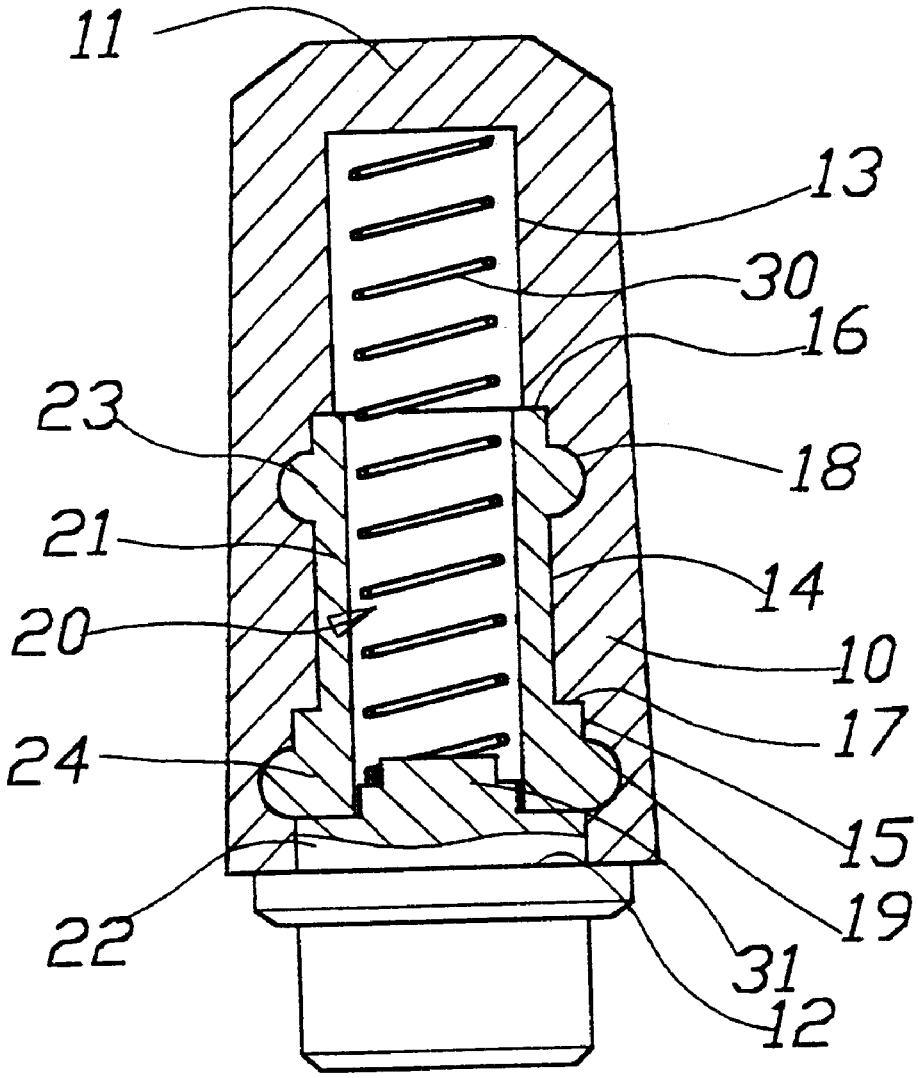
FIG. 4 is a sectional view showing assembling of the related elements such as a helical coil and a metallic connecting seat etc. of the embodiment as shown in FIG. 1.

In the interior of the structure as shown in FIG. 4, the helical coil 30 can be provided inside of the inner connecting rod 20 in advance. The bottom end of the helical coil 30 is slipped over a metallic connecting seat 31, and the top thereof can be abutted against the top end face of the first inner bore section 13 of the sleeve 10.

When the abovementioned combination structure of the present invention is produced in a factory, the sleeve and the inner connecting rod can be processed and shaped separately; then the two elements are inserted and connected directly with each other to complete the assembling work. This not only gets rid of the production mode in which the helical coil and its positioning element must be placed into a mold for ejection shaping the sleeve or doing the welding process with a fastening equipment, but also makes the assembling work faster and more convenient when in assembling in the factory. Thus it is very suitable for mass production of the antennas for the mobile phones, and indeed, the present invention is industrially valuable.

Having thus described my invention, what I claim as new and desire to be secured by Letters Patent of the United States are:

1. An antenna assembled by actions of vacuum and static electric attraction, said antenna is comprised of a sleeve and an inner connecting rod which is adapted to inserting in and connecting to said sleeve and is adapted to installing therein a helix coil and a metallic connecting seat, said sleeve and said inner connecting rod are made of flexible material of different friction coefficients; said sleeve is provided with an upper closed end and a bottom opening, an inner bore with a plurality of sections with their diameters gradually enlarged from the inside to the outside are sequentially provided therein, at least two inner annular recesses are distributed longitudinally along said antenna to prevent air from communication with the outside and to generate attraction; said inner connecting rod is provided with a plurality of rod sections corresponding by position to said sections of said inner bore, and a plurality of annular protrusions of identical cross-sectional shapes respectively to those of said annular recesses are provided on said inner connecting rod; said inner connecting rod is inserted and connected through said bottom opening of said sleeve in a mode of tight matching, connecting surfaces between said inner connecting rod and said sleeve are polished in advance in order to get smooth surfaces.

2. An antenna assembled by actions of vacuum and static electric attraction as claimed in claim 1, said inner bore with said sections of said sleeve comprises in sequence a first inner bore section, a second inner bore section and a third inner bore section with their diameters gradually enlarged from the inside to the outside, said second and third inner bore sections are provided therein respectively with said inner annular recesses which comprise correspondingly a first and a second inner annular recess having respectively diameters larger than those of said second and third inner bore sections, said inner connecting rod provided with said rod sections comprises a first and a second rod section which are provided respectively with said annular protrusions comprising a first and a second annular protrusion with identical cross-sections respectively to those of said first and second annular recesses.

3. An antenna assembled by actions of vacuum and static electric attraction as claimed in claim 1, wherein, said sleeve is made of mixed material of silicone and plastic family material, said inner connecting rod is made of pure plastic family material.

4. An antenna assembled by actions of vacuum and static electric attraction as claimed in claim 1, wherein, said sleeve is made of mixed material of rubber and plastic family material, said inner connecting rod is made of pure plastic family material.

5. An antenna assembled by actions of vacuum and static electric attraction as claimed in claim 3, wherein, ingredient of said silicone is over 30% of said mixed material.

6. An antenna assembled by actions of vacuum and static electric attraction as claimed in claim 4, wherein, ingredient of said rubber is over 30% of said mixed material.

* * * * *